US008266923B2

(12) United States Patent
Bauer et al.

(10) Patent No.: US 8,266,923 B2
(45) Date of Patent: Sep. 18, 2012

(54) REFRIGERATING DEVICE COMPRISING TWO STORAGE COMPARTMENTS WITH SELECTIVE COOLING MODES

(75) Inventors: Peter Bauer, München (DE); Erich Hell, Giengen (DE); Michael Neumann, München (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 646 days.

(21) Appl. No.: 10/593,844

(22) PCT Filed: Mar. 23, 2005

(86) PCT No.: PCT/EP2005/051352

§ 371 (c)(1),
(2), (4) Date: Mar. 26, 2007

(87) PCT Pub. No.: WO2005/093338

PCT Pub. Date: Oct. 6, 2005

(65) Prior Publication Data

US 2007/0271954 A1 Nov. 29, 2007

(30) Foreign Application Priority Data

Mar. 26, 2004 (DE) ..... 10 2004 014 926

(51) Int. Cl.
*F25D 13/02* (2006.01)
*F25D 19/02* (2006.01)
*F25B 27/00* (2006.01)

(52) U.S. Cl. ..... 62/442; 62/441; 62/448; 62/326

(58) Field of Classification Search ..... 62/440, 62/441, 442; 312/401, 406, 406.2, 407, 111, 312/109, 107
See application file for complete search history.

(56) References Cited

U.S. PATENT DOCUMENTS

| | | | | | |
|---|---|---|---|---|---|
| 3,018,637 | A | * | 1/1962 | Mann et al. | 62/155 |
| 3,135,316 | A | | 6/1964 | Foster | |
| 3,712,078 | A | * | 1/1973 | Maynard et al. | 62/448 |
| 5,377,498 | A | * | 1/1995 | Cur et al. | 62/187 |
| 5,477,915 | A | * | 12/1995 | Park | 165/206 |
| 5,485,732 | A | * | 1/1996 | Locatelli | 62/520 |
| 5,809,789 | A | | 9/1998 | Baker et al. | |
| 2002/0124590 | A1 | | 9/2002 | Rudick | |
| 2003/0000241 | A1 | * | 1/2003 | Holz et al. | 62/440 |

(Continued)

FOREIGN PATENT DOCUMENTS

DE 33 14 056 10/1984

(Continued)

OTHER PUBLICATIONS

International Search Report PCT/EP2005/051352.

*Primary Examiner* — Frantz Jules
*Assistant Examiner* — Cassey D Bauer
(74) *Attorney, Agent, or Firm* — James E. Howard; Andre Pallapies

(57) ABSTRACT

A refrigeration device comprising at least two storage compartments that are thermally insulated from one another and from the environment. In said device, an evaporator that can be cooled independently of an evaporator of the other storage compartment or compartments, is allocated to each storage compartment. Said device is equipped with elements for switching at least one of the compartments from a freezing mode to a non-freezing mode.

18 Claims, 6 Drawing Sheets

U.S. PATENT DOCUMENTS

Figure 1:
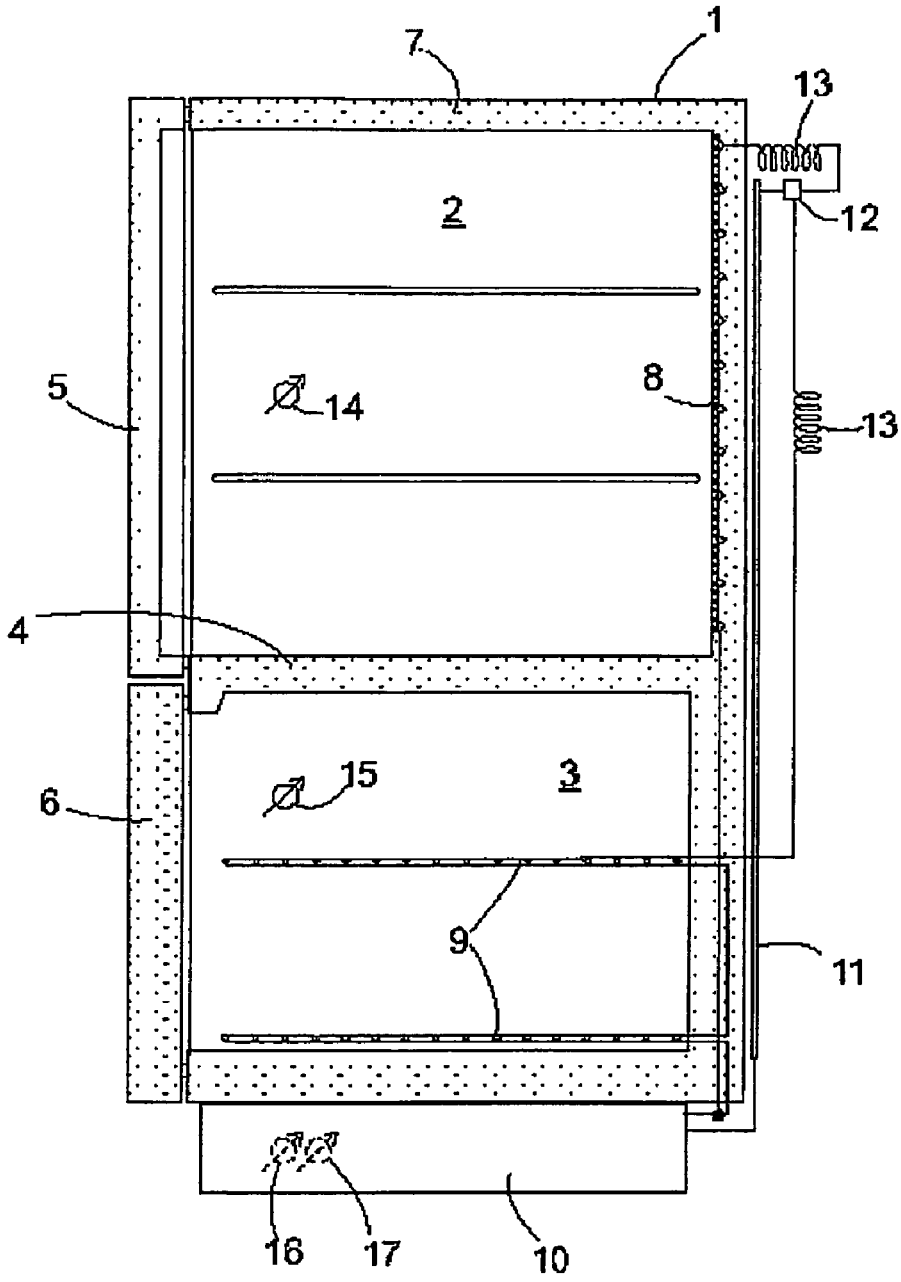

2004/0035142 A1 2/2004 Yoon et al.

FOREIGN PATENT DOCUMENTS

| | | | | |
|---|---|---|---|---|
| DE | 195 35 144 | | | 3/1997 |
| DE | 197 56 860 | | | 6/1999 |
| DE | 100 61 778 | | | 7/2002 |
| EP | 0 192 526 | | | 8/1986 |
| EP | 0 334 414 | | | 9/1989 |
| EP | 0 383 222 | | | 8/1990 |
| EP | 0383222 | a2 | * | 8/1990 |
| EP | 0541324 | | * | 3/1992 |
| EP | 1 170 561 | | | 1/2002 |
| GB | 2 225 630 | | | 6/1990 |
| JP | 2002-62028 | | | 2/2002 |
| JP | 2003-329353 | | | 11/2003 |

* cited by examiner

REFRIGERATING DEVICE COMPRISING TWO STORAGE COMPARTMENTS WITH SELECTIVE COOLING MODES

In conventional combined refrigerating appliances, the division of the useful volume into storage compartments, such as a freezing compartment and a normal refrigeration compartment, is already predetermined. When purchasing the appliance, a user must therefore decide on an internal division that suits his/her requirements, and it is not possible to alter this division during the useful life of the appliance.

This situation is unsatisfactory both for the manufacturer and the user of refrigerating appliances. The disadvantage to the user is that a large number of housing types must always be manufactured according to the different requirements of the users, who do not therefore benefit from any potential savings resulting from an increase in the volumes manufactured. The problem for the user is that deciding on a particular refrigerating appliance model at a given time definitely dictates the available installation site, so that sometimes an appliance type must be acquired which may be expected no longer to meet the requirements after a move and/or when the family grows. Very often the only option left to the user is to resell such an appliance for a price far below the value commensurate with its residual life, or to dispose of it if no buyer can be found for it.

It is therefore in the interests of both the manufacturer and the user to have refrigerating appliances that are more flexible in their possible uses than those that have previously been on the market.

The object of the invention is to provide a refrigerating appliance with such flexible use.

To achieve this object the invention relates to a refrigerating appliance with at least two storage compartments thermally insulated from each other and from the surrounding area, in which an evaporator that can be loaded with refrigerant, independently of an evaporator of at least one other storage compartment, is associated with each storage compartment. Such a refrigerating appliance is described, for example, in DE 197 56 860 A1. In this refrigerating appliance, with three compartments, with which series connected evaporators are associated, the refrigerant flow may be switched between two routes, a first route along which the refrigerant flows through all three evaporators one after the other, and a second route along which the route of the refrigerant is shortened by the evaporator positioned furthest upstream. Only when the refrigerant flows along the second route does it reach the evaporator located furthest downstream, in the partially liquid condition, and cools it; if it flows along the first route it evaporates completely before it reaches the third evaporator so that the latter remains unrefrigerated, whilst the two upstream evaporators cool their compartments. In other words, these upstream evaporators are able to refrigerate regardless of whether the downstream evaporator refrigerates simultaneously or not. This refrigerating appliance is not flexible in terms of its possible uses. Its compartments can only be used as a freezing compartment, normal refrigeration compartment or fresh storage compartment.

A further example of a combined refrigerating appliance is described in DE 195 35 144 A1. This prior art refrigerating appliance has two freezing compartments, and the refrigerant flows either only through the evaporator of the smaller of the two compartments, or through the evaporators of both compartments one after the other in order to cool down goods to be frozen newly stored in the smaller compartment.

In the refrigerating appliance according to the invention, means for switching from a freezing to at least one non-freezing mode are provided for at least one of its compartments. It is therefore possible, for example, to use a refrigerating appliance either as a combined appliance or as a non-refrigerating appliance, or as a combined appliance and as a non-freezing appliance. In other words, a user who acquires such a unit for use initially as a combined appliance may at a later time use it exclusively as a refrigerating appliance or exclusively as a freezing appliance, if a larger family makes more refrigeration space necessary, and can acquire another appliance for the missing application. Conversely allowance can also be made, of course, for a reduction in the size of the household. The user can then be certain that the appliance is able to meet his or her requirements throughout its service life.

The means for switching between freezing and non-freezing mode are preferably provided for at least two compartments of the refrigerating appliance so that its operation as a pure refrigerating appliance, as a fridge-freezer combination and as a pure freezing appliance is possible, at the discretion of the user.

In order to increase the flexibility of the appliance still further, a 0° C. mode may be set for one or the other compartment by the switching means. Since the insulation and evaporator of a compartment are designed to enable the compartment to be operated both as a freezing and as a refrigerating compartment, the additional mode as a 0° C. compartment can be achieved at negligible extra cost.

At least one of the compartments of the refrigerating appliance preferably has a wire tube evaporator for operation as a freezing compartment. If the second compartment is also to be operated as a freezing compartment, this is also preferably equipped with a wire tube evaporator; if no freezing operation is provided for the second compartment, a lateral wall evaporator, possibly in a roll bond or tubular plate design, is also sufficient.

Both compartments may also be equipped with a laminated evaporator and the appliance may therefore be operated as a no frost appliance.

In order to keep production of the refrigerating appliance simple, and in order to be able to produce it in the largest possible series, it is desirable for the first and second compartments to be insulated to the same degree. This is particularly appropriate when it is left completely up to the user to decide whether the first or second compartment, or possibly both or none, is to be used as a freezing compartment.

In this case it is particularly appropriate for the first and second compartments to have different volumes, but for them to be capable of operating in the same plurality of operating conditions. This therefore provides two different possibilities of use as combined appliances, on the one hand with the larger and on the other with the smaller compartment as the freezing compartment, always according to the requirements of the user.

If the costs of the insulating material are to be kept low, provision may also be made for one of the compartments to be insulated with thinner material than the other, in which case only the thicker insulated of the two compartments being capable of being suitably switched to freezing mode.

A compressor can be installed by a prior art method in a recess left in one of the compartments, or sockets may be installed in offset fashion in one of the two compartments. In the latter case in particular it is appropriate for the two compartments to be formed in a body which can be connected to the socket either in a first orientation or in a second orientation rotated 180° relative to the first orientation. Thus a given compartment of the housing may be positioned in the ready assembled refrigerating appliance at the top or at the bottom according to the requirements of the user. In other words, even if the compartments are insulated to different thicknesses, or if only one of the compartments can be switched to freezing mode for other reasons, a so-called top freezer or bottom freezer can be obtained from the same components, at the discretion of the user, or the larger of two compartments of different sizes may be placed at the top or bottom, according to the preference of the user.

Figure 4:
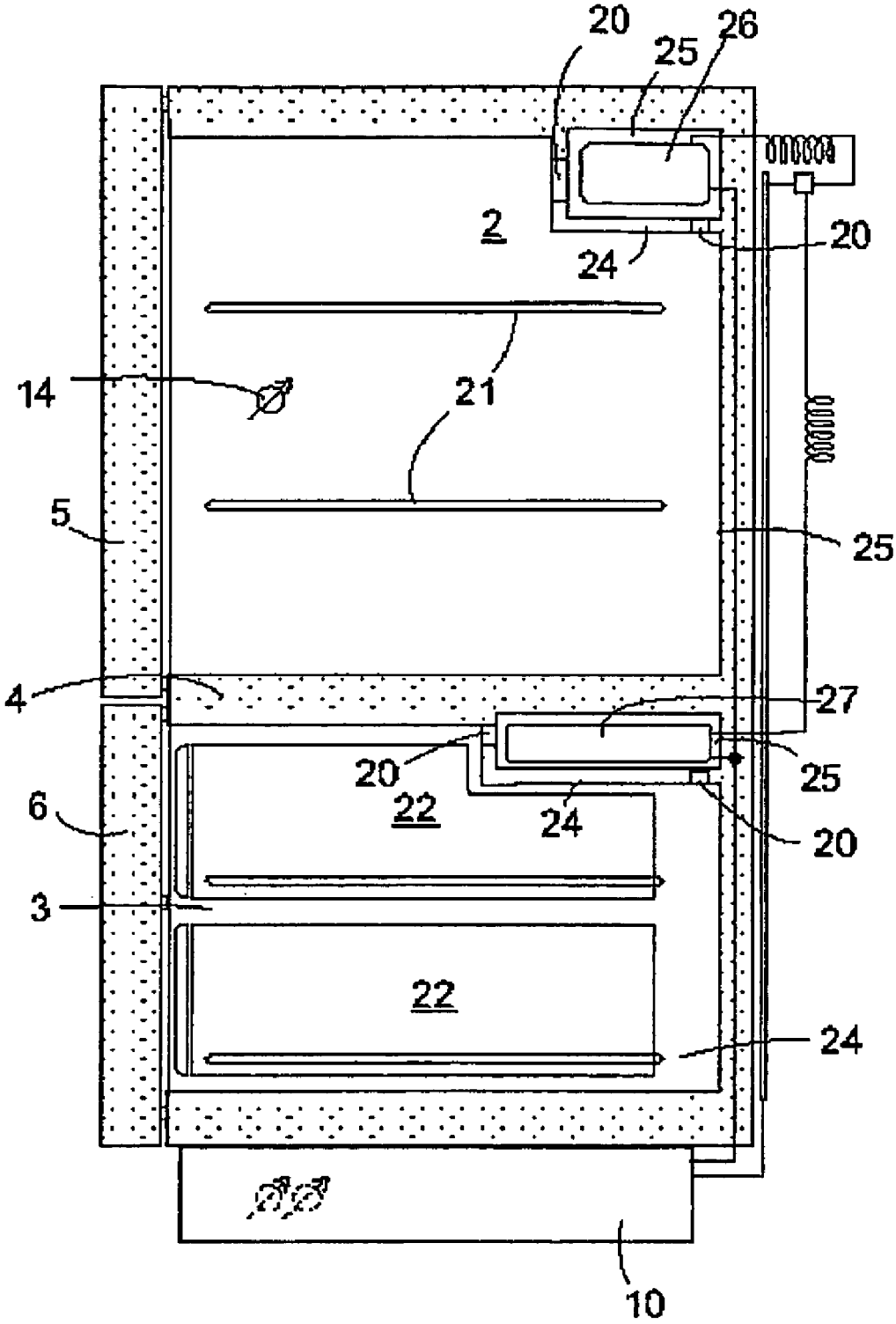
Figure 5:
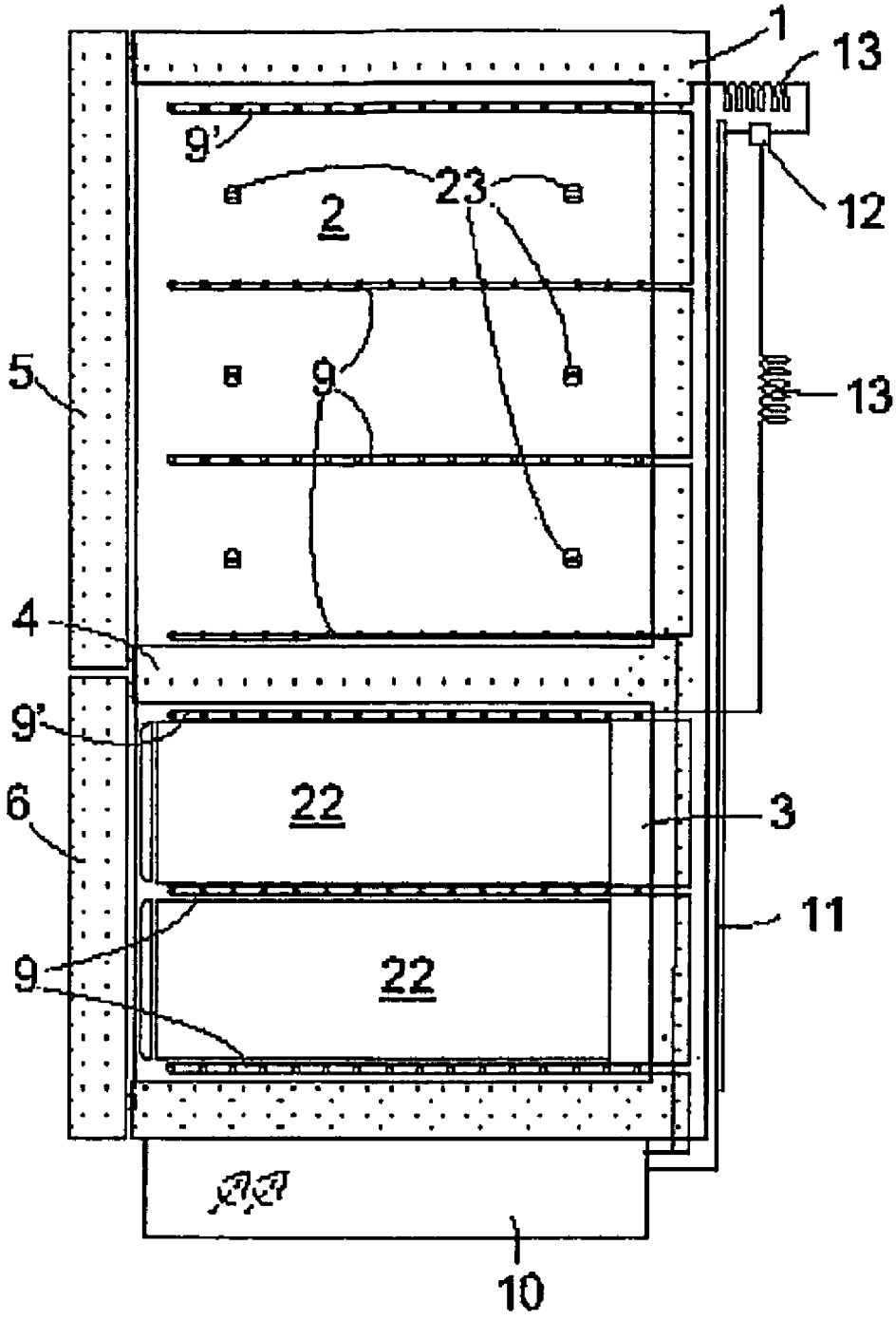
Figure 6:
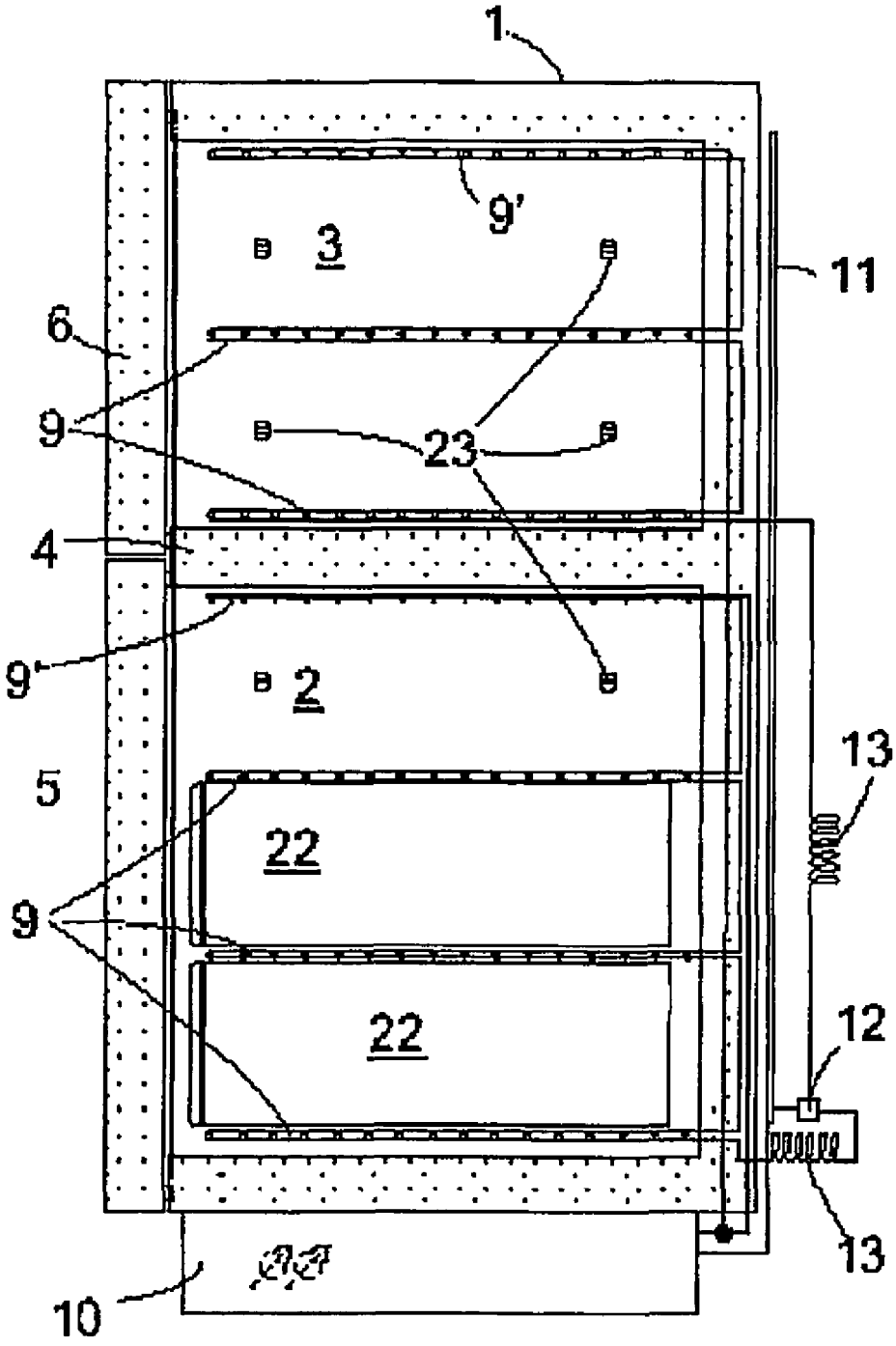

Further features and advantages of the invention are evident from the following description of exemplary embodiments with reference to the attached figures, where FIGS. 1 to 5 each show a diagrammatic section through a refrigerating appliance according to a first to fifth embodiment of the invention; and FIG. 6 shows a section through the refrigerating appliance of the fifth embodiment in another design.

The refrigerating appliance shown in FIG. 1 is composed essentially of a thermally insulating body 1, in which are formed two thermally insulated compartments 2, 3 offset from each other by a partition 4. Each compartment is sealed by a door 5 or 6, which is hinged to the front side of body 1.

The thickness of insulating layer 7 of the body is smaller in upper compartment 2 than in lower compartment 3, and accordingly the wall thickness of upper door 5 is also smaller than that of the lower door. Upper compartment 2 is provided exclusively for operation above freezing point, e.g. as a refrigeration compartment or as a larder compartment; an evaporator 8, designed as a so-called cold wall evaporator, in the fashion of a roll bond or tubular plate, which is embedded on the rear wall of compartment 2 between a plastic internal receptacle and insulating layer 7, is provided for cooling this compartment.

Two wire tube evaporators 9, which are formed in a manner of prior art from a tube which is bent in one plane in a meander fashion, which is stiffened by wire cross struts, and through which refrigerant flows, are used for cooling lower compartment 3. The two wire tube evaporators 9 are connected to each other in series.

A compressor of the refrigerating appliance, not shown, is installed in a socket 10, forming a so-called socket unit, on which rests body 1. A suction connection, to which outputs of plate evaporator 8 and downstream wire tube evaporator 9 are connected, forming a parallel connection of the two evaporators 8 and 9, is guided into socket 10 towards the compressor. Furthermore, the compressor has a pressure connection via which refrigerant sucked in from evaporators 8, 9 and compressed is fed to a liquefier 11. Liquefier 11 is shown as a plate-like component on the rear side of body 1, but it may also be installed together with the compressor in socket unit 10.

A solenoid valve 12, which, like the compressor, is subject to the control of a temperature control circuit (not shown), is connected to an output of liquefier 11. This control establishes a refrigeration requirement of compartments 2, 3 on the basis of air temperatures measured in each of compartments 2, 3, for example, and switches the compressor on and off according to this requirement and always guides the refrigerant flow, by means of solenoid valve 12, via a throttle 13 to the one of compartments 2, 3 in which a refrigeration requirement has been established.

As shown symbolically here, two regulators 14, 15, are connected to the temperature control circuit. These regulators, as shown in the figure, may be fitted on either lateral wall of the internal receptacle of compartment 2 or 3 to which they are associated, and they enable a user to set a theoretical temperature for compartment 2, 3. According to a first, simple embodiment, the regulators have a continuous setting range for the theoretical temperature, which, in the case of compartment 2, with thin insulation, may range from a lower limit in the neighbourhood of 0° C., to an upper limit of approx. +12° C., for example, and in the case of the lower compartment, with thicker insulation, it may range, for example, from −18° C. to +12° C. By setting the appropriate theoretical temperature a user may use upper compartment 2, for example, as a 0° compartment, a normal refrigerating compartment with a typical theoretical temperature of approx. +7° C., or as a larder compartment with a typical temperature of +10° C. to 12° C., whilst lower compartment 3 may, in addition, also be operated as a freezing compartment.

According to a modification of this, regulators 14, 15, arranged so that they are easily accessible to the user, only allow the theoretical temperature of the compartment associated with them to be set within an interval having a range of only a few degrees, typically approx. 4 to 5° C., the position of the interval being established by a mode selector switch associated with the compartment concerned, such as selector switches 16, 17 in socket 10, denoted by a dotted line in FIG. 1. This modification on the one hand enables the theoretical temperature to be set more finely by means of regulators 14, 15, within the pre-selected interval, than is impossible in the variant first described, without a selector switch. Moreover, because of the narrow range of the setting interval of regulators 14, 15, the user is prevented from unintentionally switching a compartment to an incorrect mode, for example from freezing to 0° or normal refrigerating operation, or from normal refrigerating to freezing operation, which in both cases could damage the content of the compartment, by inadvertently adjusting these regulators.

As a further modification of the embodiment shown, regulators 14, 15 or, if provided, selector switches 16, 17 may also be arranged on a control panel on the outside of the appliance, e.g. on a screen fitted outside the doors or between doors 5, 6. To prevent unintentional actuation of the selector switches they may, for example, be concealed by a flat, whilst regulators 14, 15 are freely mounted on the control panel.

Figure 2:
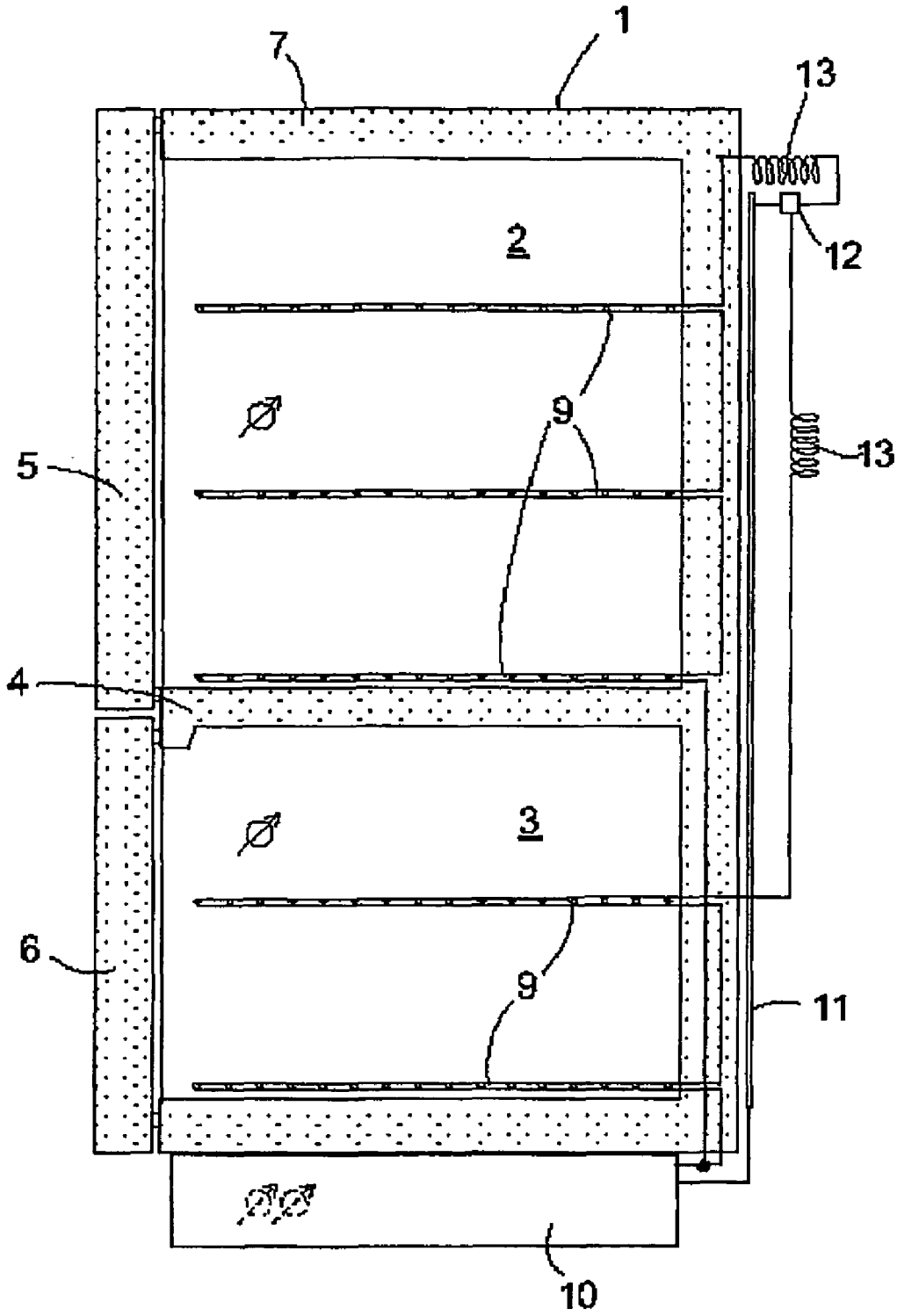

FIG. 2 shows a section through a second embodiment of the refrigerating appliance according to the invention. This differs from the first embodiment in that the thickness of insulating layer 7 surrounding the compartments, and hence the thermal insulation capacity of the compartment walls of both compartments 2, 3, is the same, and in that both compartments 2, 3 are each cooled by wire tube evaporators 9 connected in series inside a compartment. Wire tube evaporators 9 at the same time form compartment bottoms which divide compartments 2, 3.

In this embodiment both compartments 2, 3 are equally suitable for operation as a freezing compartment. The refrigerating appliance may therefore be used, at the discretion of the user, as a pure freezing appliance or as a fridge/freezer combination, namely as a so-called top freezer or bottom freezer. When operated as a combined appliance the user even has the possibility, if both compartments 2 and 3 have different useful volumes, to choose between two different volumes of the freezing space. In exactly the same way, however, it is also possible to provide both compartments 2 and 3 with the same useful volume.

Conversely, the manufacturer can cover with one appliance model a wide range of user requirements, so that the appliance can be manufactured in high volumes and can be offered at a correspondingly low price.

Figure 3:
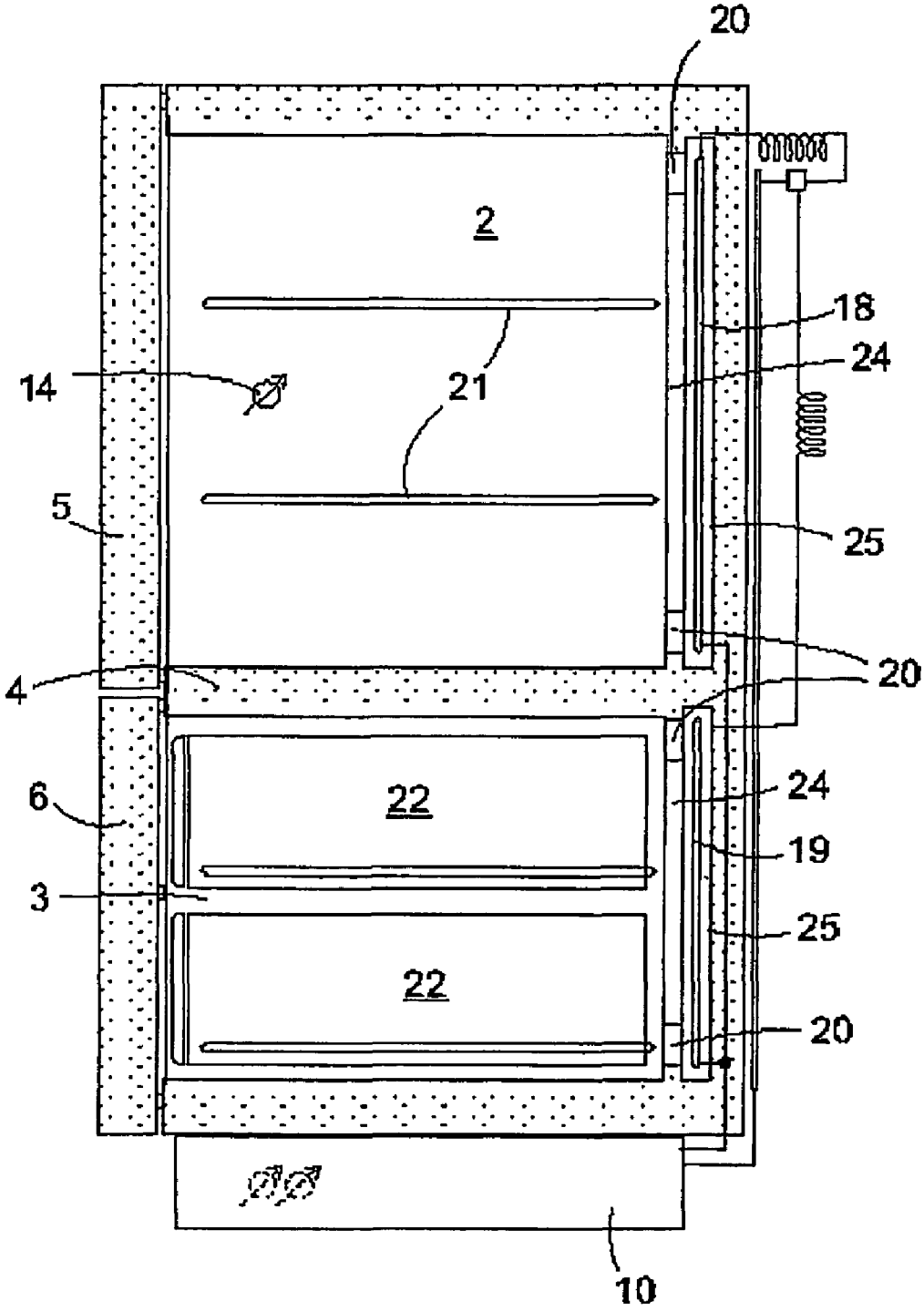

FIG. 3 shows, as a third embodiment of the invention, a refrigerating appliance with rear wall evaporators provided in both compartments 2 and 3. A plate-type evaporator 18, 19, which is installed in a chamber 25 separated from the associated compartment 2 or 3 by a partition 24, is associated with each of the two compartments 2, 3. Openings 20 in partition 24, if necessary in conjunction with forced circulation, allow an exchange of air between chamber 25 and compartment 2 or 3.

The omission of the wire tube evaporators allows flexible use of the volume of compartments 2, 3 by means of compartment bottoms 21 or rail-guided pull-out drawers 22, each of which can be removed from their compartments and can be installed at different heights as required. FIG. 3 shows upper compartment 2 fitted with compartment bottoms 21 for use as a normal refrigerating compartment, and lower compartment 3 fitted with pull-out drawers 22 for use as a larder compartment or as a zero degree compartment. However, compartment bottoms and pull-out drawers can be installed in each of the compartments, so that if compartment 2 is intentionally used as a larder or zero degree compartment, pull-out drawers 22 could also be used there and compartment bottoms 21 could be transferred to lower compartment 3 so that this compartment could be used as a refrigerating compartment, for example. A user who has acquired the appliance with the internal equipment shown in the figure may, for example, purchase a pull-out drawer 22 later when he wishes to use upper compartment 2 permanently as a larder compartment and the lower compartment as a refrigerating compartment, or he may purchase three additional pull-out drawers so that the appliance is used exclusively as a "larder compartment and zero degree compartment appliance", so that upper compartment 2 is fully fitted.

Obviously the height ratio of 3:2 between compartments 2 and 3 is given purely as an example; a height of compartment 2, equivalent to four pull-out drawers 22, could equally well be considered.

The embodiment according to FIG. 4 shows a refrigerating appliance in the no-frost design, with laminar evaporators 26, 27 force ventilated by a fan, not shown, serving as evaporators, installed in chambers 25 designed as an evaporator space, which chambers are arranged in an evaporator space outside compartments 2, 3, thermally separated from them, and are divided by a partition 24, for example, in an upper rear region of compartments 2 and 3. The cold air is fed from the fan via each evaporator 26 and 27, then via openings 20, into air guide channels on the rear wall of compartments 2 and 3, and enters compartments 2 and 3 via air outlet openings in air guide channels, to cool them. The cooling air channels and the air outlet openings provided in them are selected so that at least an almost uniform temperature level prevails inside compartments 2 and 3.

Both compartments 2 and 3 may be operated as a refrigerating compartment, larder compartment, zero degree compartment or as a freezing compartment, according to the setting, by the use of laminar evaporators 26 and 27. Any combination of modes is also possible according to the requirement.

In the embodiment shown in FIG. 5, compartments 2, 3 are divided by wire tube evaporators 9, as shown in FIG. 2. In this case, however, unlike the embodiment shown in FIG. 2, one of these wire tube evaporators, denoted by 9, is provided in each compartment 2, 3 in the immediate vicinity of the compartment cover. The wire tube evaporators are not only supported on the internal receptacle of each compartment, but are also mounted at the top and bottom. This enables the same body 1 to be mounted on socket 10 in a configuration turned 180°, with the larger compartment 2 at the bottom, as shown in FIG. 6. In both orientations the wire tube evaporators can be loaded with goods to be refrigerated. For example, a user who prefers a bottom freezer configuration may select the arrangement shown in FIG. 5 if he only requires the small compartment 3 as a freezing compartment, and he may use the turned configuration shown in FIG. 6 if he wants to use the larger compartment 2 as a freezing compartment. Mountings 23, to which rails may be secured for pull-out drawers 22, are arranged on the lateral walls of the internal receptacles of compartments 2, 3, exactly half-way between two evaporators 9, so that the rails can be suspended on them regardless of the orientation of body 1.

Obviously the possibility may also be provided, in an appliance in no-frost technology such as that shown in FIG. 4, of mounting body 1 in two different orientations on socket unit 10.

Instead of in a socket, the compressor of the refrigerating appliance may obviously also be installed in a recess that is formed in one of the compartments and is open towards the rear side of the appliance. Since such a housing design is widely used, it is not shown in a separate figure. The possibility may also be provided in such an appliance of placing the body on the head, as shown in the embodiment in FIGS. 4 and 5, in which case a compressor recess originally provided in a lower rear corner of the body will naturally come to rest on the top of the housing.

What is claimed is:

1. A refrigerating appliance comprising:

at least two storage compartments thermally insulated from each other and from a surrounding area and installed in a cabinet;

a compressor is installed in a socket unit;

an evaporator, which can be cooled independently from an evaporator of at least one other storage compartment, being provided with each storage compartment, wherein the evaporator from one of the compartments comprises two evaporators connected in series, and wherein the evaporators are mounted at least at a top of a top one of the storage compartments and at a bottom of a bottom one of the storage compartments such that the refrigerating appliance is operable in a first orientation where the cabinet is mounted on the socket unit and a second orientation where the cabinet is inverted from the first orientation mounted on the socket unit; and means for switching the mode of operation of at least one of the compartments between a freezing mode and a non-freezing mode.

2. The refrigerating appliance according to claim 1, wherein the means for switching the mode of operation also allow switching to a 0° C. mode.

3. The refrigerating appliance according to claim 1, wherein the means for switching the mode of operation are provided for the at least two compartments.

4. The refrigerating appliance according to claim 1, wherein at least one of the compartments has a wire tube evaporator.

5. The refrigerating appliance according to claim 4, wherein another of the compartments has a lateral wall evaporator.

6. The refrigerating appliance according to claim 4, wherein another of the compartments also has a wire tube evaporator.

7. The refrigerating appliance according to claim 1, wherein at least one of the compartments has a no-frost evaporator.

8. The refrigerating appliance according to claim 7, wherein the no-frost evaporator includes a laminar evaporator.

9. The refrigerating appliance according to claim 7, wherein the no-frost evaporator includes a plate-type design evaporator.

10. The refrigerating appliance according to claim 1, wherein the first and second compartments have insulation of substantially the same thickness.

11. The refrigerating appliance according to claim 10, wherein the first and second compartments have different volumes and can be operated in the same plurality of operating modes.

12. The refrigerating appliance according to claim 1, wherein at least one of the compartments cannot be switched to a freezing mode, and has a thinner insulation than the other of the compartments which can be switched to the freezing mode.

13. The refrigerating appliance according to claim 1, wherein the means for switching the mode of operation of at least one of the compartments between a freezing mode and a non-freezing mode includes a regulator and a selector switch.

14. The refrigerating appliance according to claim 13, further comprising a second regulator and a second selector switch, wherein each of the compartments is associated with one of the regulators and selector switches to control the mode of operation within the compartment.

15. The refrigerating appliance according to claim 1, wherein the evaporators of each of the storage compartments are connected in parallel to effect the independent cooling.

16. A refrigerating appliance comprising:

at least two storage compartments thermally insulated from each other and from a surrounding area and installed in a cabinet;

a compressor is installed in a socket unit;

an evaporator, which can be cooled independently from an evaporator of at least one other storage compartment, being provided with each storage compartment, the evaporators of each of the storage compartments being connected in parallel to effect the independent cooling, wherein one of the evaporators from one of the compartments comprises two evaporators connected in series, and wherein each of the storage compartments is operable in a plurality of operating modes of different temperatures;

wherein the refrigerating appliance is operable in a first orientation where the cabinet is mounted on the socket unit and a second orientation where the cabinet is inverted from the first orientation mounted on the socket unit;

a mode switch cooperable with the evaporator and acting to switch the mode of operation of the compartments between the operating modes; and a regulator for each of the storage compartments, the regulators communicating with a temperature control circuit and respectively controlling a temperature in each of the compartments, wherein the regulators are constructed to be set within an interval having a range of 4-5° C., a position of the interval being established by the mode switch.

17. The refrigerating appliance according to claim 16, wherein the plurality of operating modes for each of the storage compartments are the same.

18. The refrigerating appliance according to claim 16, wherein the plurality of operating modes for each of the storage compartments are different.

* * * * *